US006705689B2

(12) United States Patent
Chen et al.

(10) Patent No.: US 6,705,689 B2
(45) Date of Patent: Mar. 16, 2004

(54) TRACK DEVICE ALLOWING SEQUENTIAL INWARD MOVEMENT

(75) Inventors: Ken-Ching Chen, Kaohsiung Hsien (TW); I-Ming Tseng, Kaohsiung Hsien (TW); Shu-Jiuan Lin, Kaohsiung Hsien (TW)

(73) Assignee: King Slide Works Co., Ltd. (TW)

( * ) Notice: Subject to any disclaimer, the term of this patent is extended or adjusted under 35 U.S.C. 154(b) by 69 days.

(21) Appl. No.: 10/103,293

(22) Filed: Mar. 22, 2002

(65) Prior Publication Data

US 2003/0178922 A1 Sep. 25, 2003

(51) Int. Cl.[7] ..... A47B 88/02
(52) U.S. Cl. ..... 312/334.46; 312/333
(58) Field of Search ..... 312/333, 334.44, 312/334.45, 334.46, 334.47; 384/21

(56) References Cited

U.S. PATENT DOCUMENTS 4,469,384 A * 9/1984 Fler et al. ..... 312/333
4,932,792 A * 6/1990 Baxter ..... 312/334.46 X
5,181,782 A * 1/1993 Wojcik ..... 312/334.44 X
5,577,821 A * 11/1996 Chu ..... 312/334.11
6,244,678 B1 * 6/2001 Dopp et al. ..... 312/333
6,350,001 B1 * 2/2002 Chu ..... 312/334.44
6,585,335 B2 * 7/2003 Hwang et al. ..... 312/333
2002/0140331 A1 * 10/2002 Chen et al. ..... 312/334.46

FOREIGN PATENT DOCUMENTS

DE 2603753 * 8/1977 ..... 312/334.46

* cited by examiner

*Primary Examiner*—Janet M. Wilkens
(74) *Attorney, Agent, or Firm*—Bacon & Thomas, PLLC

(57) ABSTRACT

A track device. The track device includes a first track, a second track, and a third track. The first track includes a first stop and an engaging block. The second track is slidably received in the first track. The second track includes a second stop for abutting against the first stop of the first track. The second track further includes a first engaging member on an end thereof. The first engaging member includes an extension member, the extension member including an engaging section and a foot. The third track is slidably received in the second track. The third track includes a second engaging member for abutting against a third stop of the second track. The second engaging member includes an engaging edge and a leg. The leg is pressable to allow disengagement of the engaging edge from a protrusion on the third stop.

3 Claims, 5 Drawing Sheets

TRACK DEVICE ALLOWING SEQUENTIAL INWARD MOVEMENT

BACKGROUND OF THE INVENTION

1. Field of the Invention

The present invention relates to a track device including three tracks that are moved inward in sequence when desired.

2. Description of the Related Art

FIG. 8 of the drawings illustrates a so-called "three-track" conventional track device for a drawer. The track device includes an outer track 91, a middle track 92, and an inner track 93. A plurality of rolling balls 94 are mounted between the middle track 92 and the inner track 93 to allow easy sliding movement of the inner track 93 in the middle track 92. In order to allow easy assembly, the inner track 93 has a claw 95 with a resilient leg 96 and the middle track 92 has a stop 97. The resilient leg 96 can be pressed to allow the claw 95 to move across the stop 97, thereby allowing assembly or detachment between the inner track 93 and the middle track 92. After the inner track 93 has been engaged in the middle track 92, the claw 95 is engaged with the stop 97 when the inner track 93 is pulled outward to a predetermined position, thereby preventing disengagement of the inner track 93 from the middle track 92.

The outer track 91 is attached to a side of, e.g., a cabinet, and the inner track 93 is attached to a lateral side of, e.g., a drawer of the cabinet. Of course, two sets of the track devices are provided to each lateral side of the drawer. However, no means is provided to prevent inadvertent inward movement of the inner track 93 into the middle track 92 when the inner track 93 is inadvertently impinged. The user's elbow might be injured.

SUMMARY OF THE INVENTION

An object of the present invention is to provide a track device having a first track, a second track, and a third track. When the track device is extended, members provided between the first track and the second track engage with each other such that the third track and the second track are moved inward in sequence for collapsing the track device while inadvertent sudden closing of the track device is avoided.

A track device in accordance with the present invention comprises a first track, a second track, and a third track. The first track comprises an upper longitudinal lip and a lower longitudinal lip. The first track further comprises a first stop and an engaging block. The second track is slidably received between the upper longitudinal lip and the lower longitudinal lip of the first track. The second track comprises a second stop for abutting against the first stop of the first track. The second track further includes a third stop with a protrusion. The second track further includes an upper longitudinal lip and a lower longitudinal lip. The second track further includes a first engaging member on an end thereof. The first engaging member includes an extension member, the extension member including an engaging section and a foot. The third track is slidably received between the upper longitudinal lip and the lower longitudinal lip of the second track. The third track includes a second engaging member for abutting against the third stop of the second track. The second engaging member includes an engaging edge and a leg. The leg is pressable to allow disengagement of the engaging edge from the protrusion on the third stop.

Other objects, specific advantages, and novel features a track device including three tracks that are moved inward in sequence when desired of the invention will become more apparent from the following detailed description and preferable embodiments when taken in conjunction with the accompanying drawings.

DETAILED DESCRIPTION OF THE PREFERRED EMBODIMENTS

A preferred embodiment in accordance with the present invention will now be described with reference to the accompanying drawings.

Figure 1:
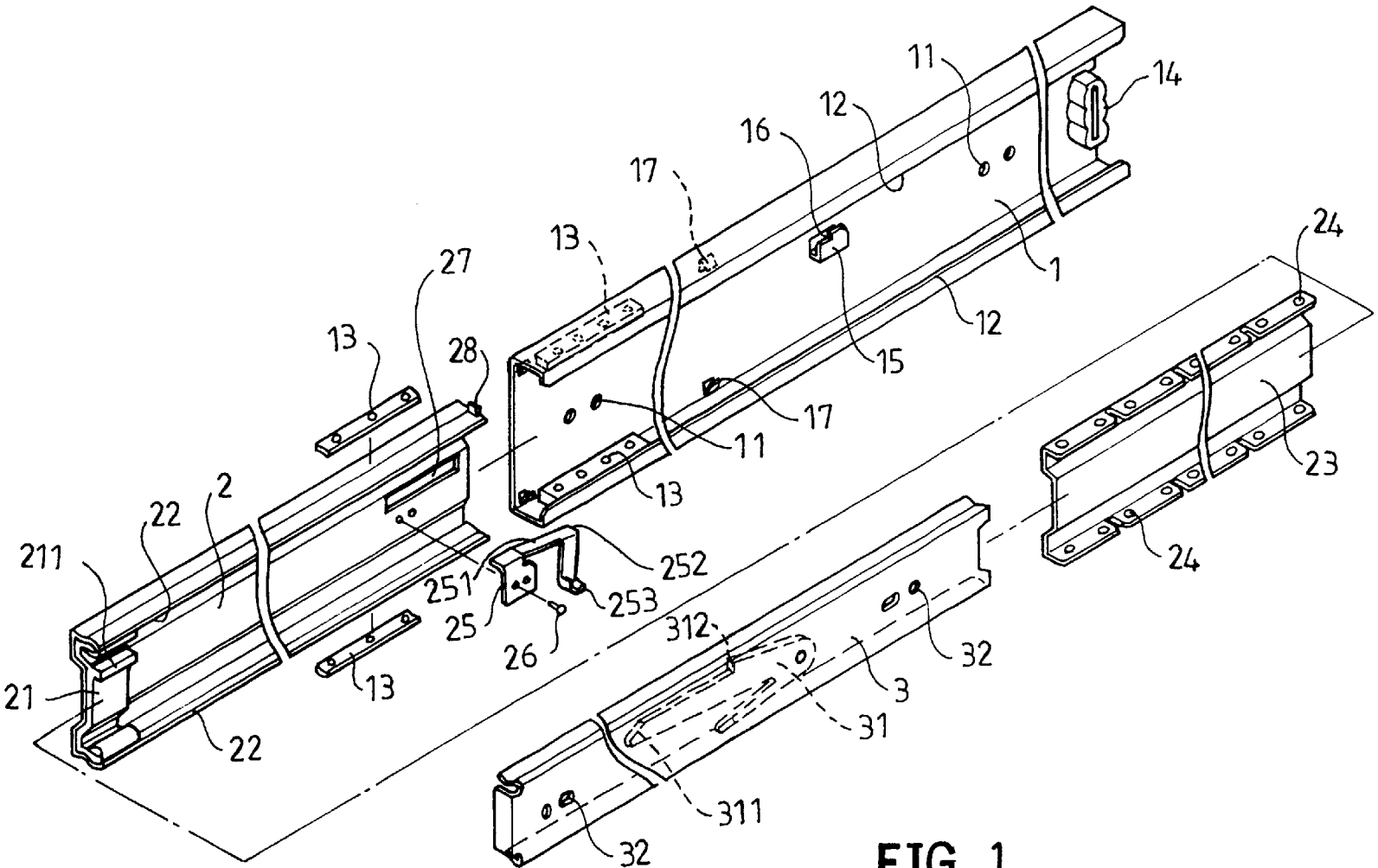
FIG. 1 is an exploded perspective view of a track device in accordance with the present invention.

Referring to FIG. 1, a track device in accordance with the present invention generally includes a first track 1, a second track 2, and a third track 3. The first track 1 comprises holes 11 so as to be fixed by nails to a wall of furniture. The first track 1 further includes an upper longitudinal lip 12, a lower longitudinal lip 12 for restraining longitudinal movement of the second track 2 in the first track 1. Slide-aiding members 13 may be mounted between the first track 1 and the second track 2. The first track 1 further includes a stop 17 for preventing disengagement of the second track 2 from the first track 1. The first track 1 further includes a fixed block 14 on an end thereof, thereby preventing disengagement of the second track 2 through the end of the first track 1. Further, the first track 1 includes an engaging block 15 having a stepped retaining portion 16.

The second track 2 is mounted into and movable between upper and lower longitudinal lips 12. Also, the second track 2 includes upper and lower longitudinal lips 22 between which the third track 3 is slidably mounted. A slide-aiding member 23 is provided between the second track 2 and the third track 3. In a preferred embodiment, the slide-aiding member 23 is an integral member and includes balls 24 for providing optimal rolling contact between the second track 2 and the third track 3.

The second track 2 includes two stops 21 and 28 respectively on two ends thereof for preventing disengagement of the third track 3 from the second track 2 and for preventing disengagement of the second track 2 from the first track 1. A slot 27 is defined in an end of the second track 2. Adjacent to the slot 27 there is provided a first engaging member 25 that is fixed by fasteners (such as rivets 26) to the second track 2. The first engaging member 25 includes an extension member 251 having an engaging section 252 and a foot 253 extending downward. When the second track 2 moves outward relative to the first track 1, the extension member 251 moves across the engaging block 15 of the first track 1. When the second track 2 moves inward into the first track 1, the engaging section 252 abuts against the stepped retaining portion 16 of the engaging block 15, thereby preventing inward movement of the second track 2. When the foot 253 of the first engaging member 25 is pressed against by a bottom of the third track 3, the extension member 251 is lifted for separating the engaging section 252 from the stepped retaining portion 16 of the engaging block 15. Further, the slot 27 of the second track 2 receives the first engaging member 25 for restraining movement of the first engaging member 25 in the slot 27.

The third track 3 is mounted in the second track 2 and movable between the upper and lower longitudinal lips 22. The third track 3 includes holes 32 so as to be fixed by nails to a lateral side of a drawer of the furniture. The third track 3 includes a second engaging member 31. When the third track 3 is engaged in the second track 2, and when the third track 3 is pulled outward, an engaging edge 312 of the second engaging member 31 abuts against a protrusion 211 of the stop 21 of the second track 2, thereby preventing disengagement of the third track 3 from the second track 2. Further, the second engaging member 31 includes a resilient leg 311. When engagement/disengagement of the third track 3 with/from the second track 2 is required, the resilient leg 311 is pressed to separate the engaging edge 312 of the second engaging member 31 from the protrusion 211 of the stop 21. Thus, the second engaging member 31 of the third track 3 may move across the stop 21 of the second track 2.

Figure 2:
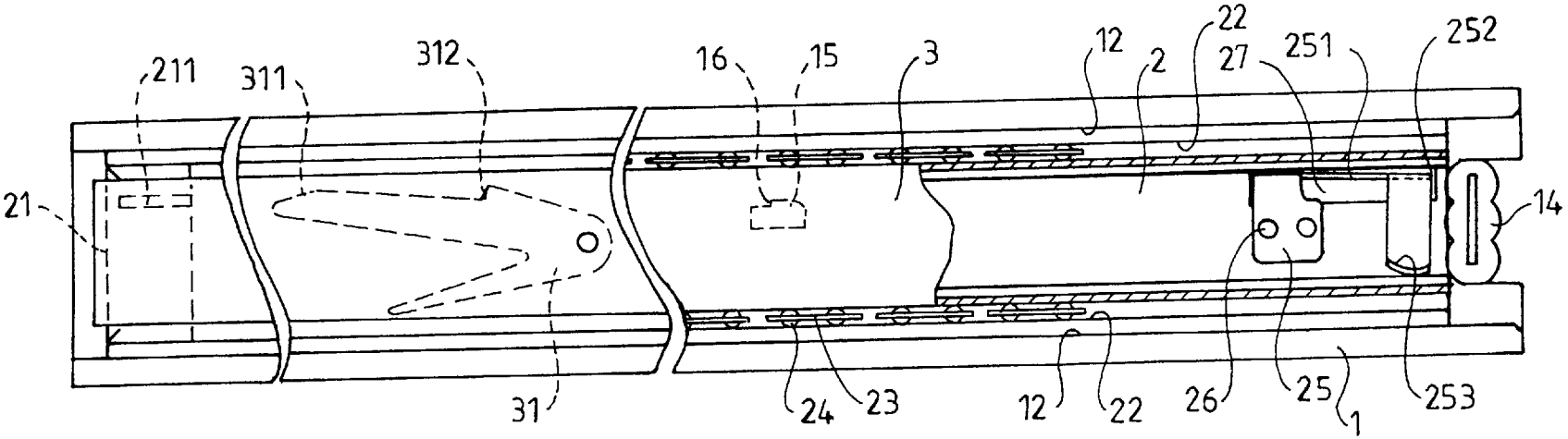
FIG. 2 is a sectional view of the track device in accordance with the present invention in a fully collapsed state.

As illustrated in FIGS. 1 and 2, the engaging block 15 having a stepped retaining portion 16 is provided on the first track 1 and the first engaging member 25 is provided on the second track 2. The stepped retaining portion 16 is fixed in an appropriate position of the first track 1. In a preferred embodiment, the stepped portion 16 is located approximately a middle portion of the first track 1. The first engaging member 25 is fixed on an end of the second track 2 that is in first contact with the first track 1 during assembly. The extension member 251 of the first engaging member 25 is slightly deformable to allow the extension member 251 to move across the engaging block 15 of the first track 1 until the engaging section 252 abuts against the stepped retaining portion 16 of the engaging block 15, and the foot 253 of the first engaging member 25 may be pressed against by the bottom of the third track 3 to lift the extension member 251 of the first engaging member 25, thereby disengaging the engaging section 252 from the stepped retaining portion 16 of the engaging block 15.

Figure 3:
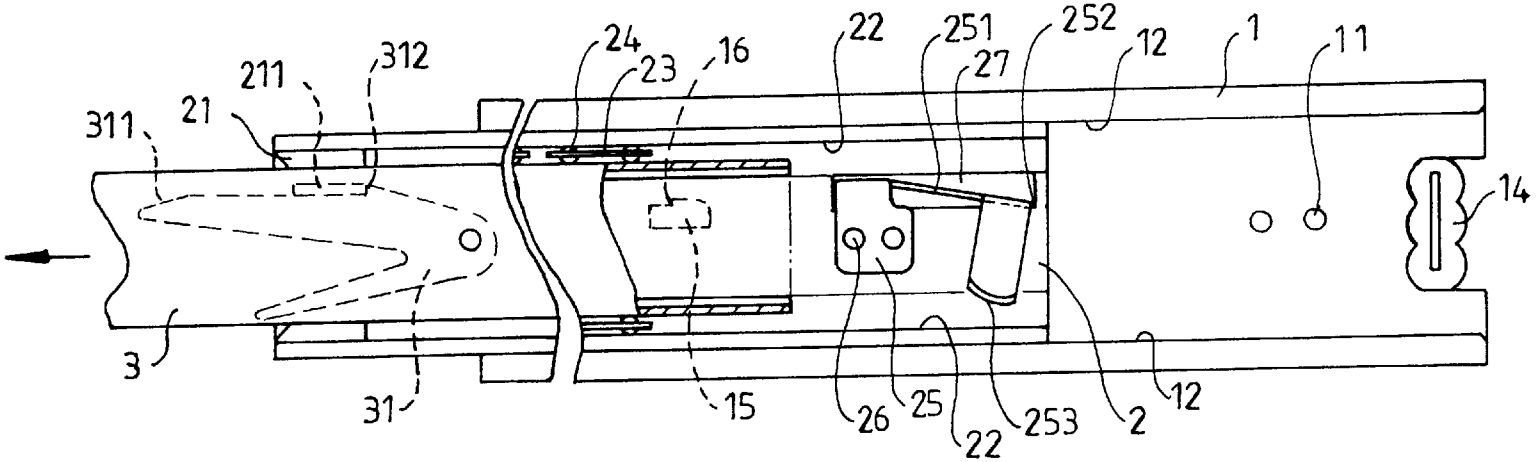
FIG. 3 is a sectional view similar to FIG. 2, wherein the track device is pulled to its fully extended state.
Figure 4:
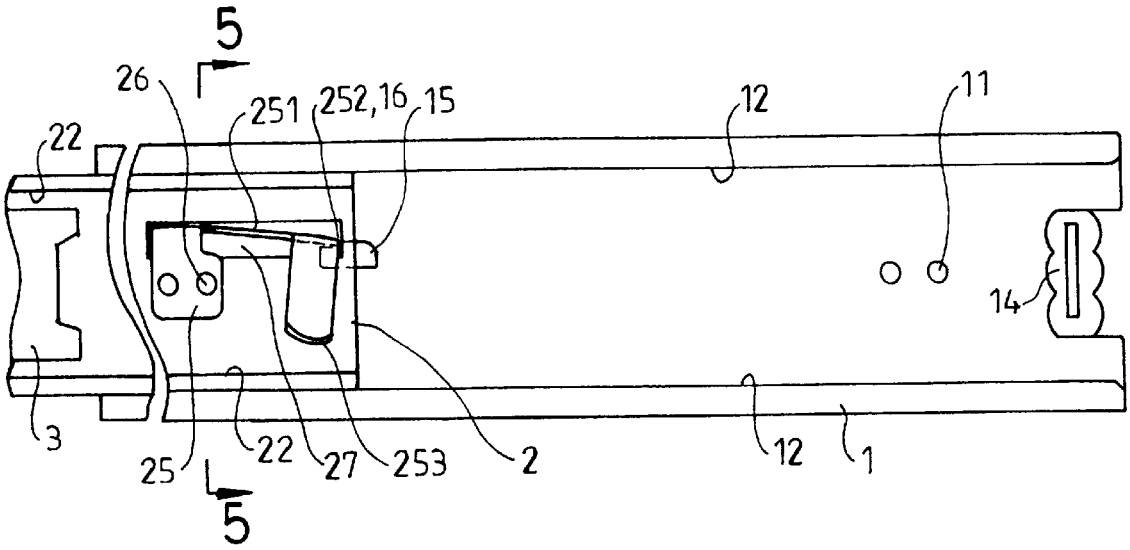
FIG. 4 is a view illustrating inward movement of a second track into a first track of the track device.

Referring to FIGS. 3 and 4, when extending the track device, the third track 3 is moved away from the second track 2 until the second engaging member 31 abuts against and is thus stopped by the stop 21 on the second track 2. The second track 2 is moved away from the first track 1. The extension member 251 of the first engaging member 25 is moved across the engaging block 15. The second track 2 is stopped when the stop 28 of the second track 2 abuts against the stop 17 on the first track 1. At this time, the track device is in a fully extended state.

Figure 5:
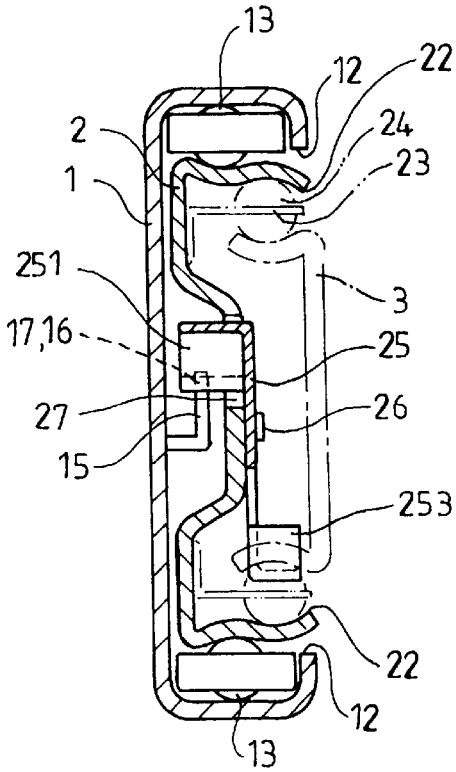
FIG. 5 is a sectional view taken along plane 5—5 in FIG. 4.

Referring to FIGS. 4 and 5, when the track device in the fully extended state is inadvertently impinged, the second track 2 is allowed to move for a relatively short distance relative to the first track 1, as the engaging section 252 of the first engaging member 25 on the second track 2 abuts against the stepped retaining portion 16 of the engaging block 15 on the first track 1. Thus, further inward movement of the second track 2 into the first track 1 is not allowed. As a result, the drawer of the furniture would not be closed suddenly.

Figure 6:
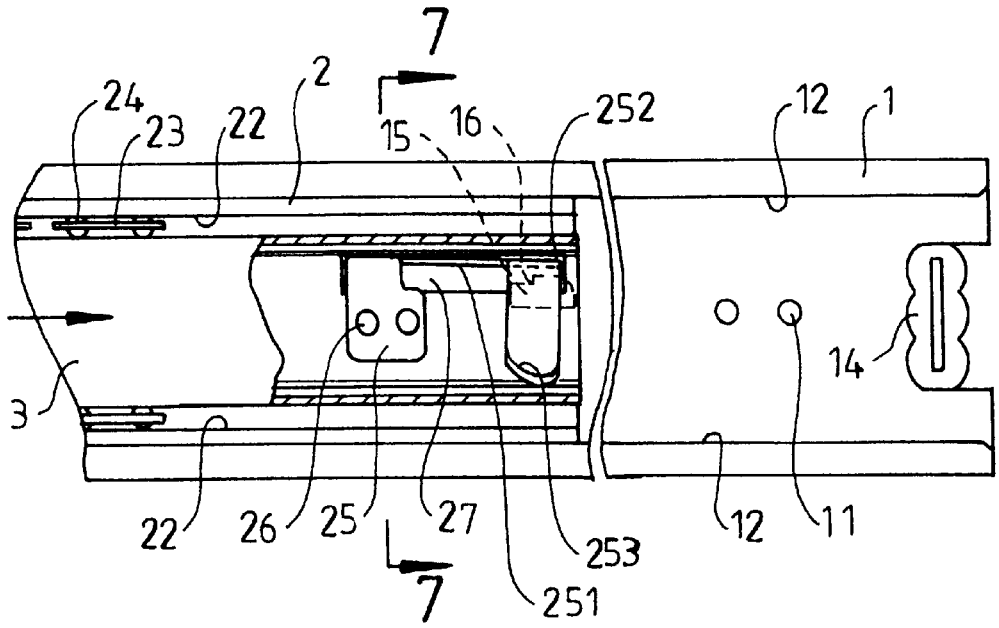
FIG. 6 is a sectional view illustrating pressing of a lip of a third track against a foot of a retaining member.
Figure 7:
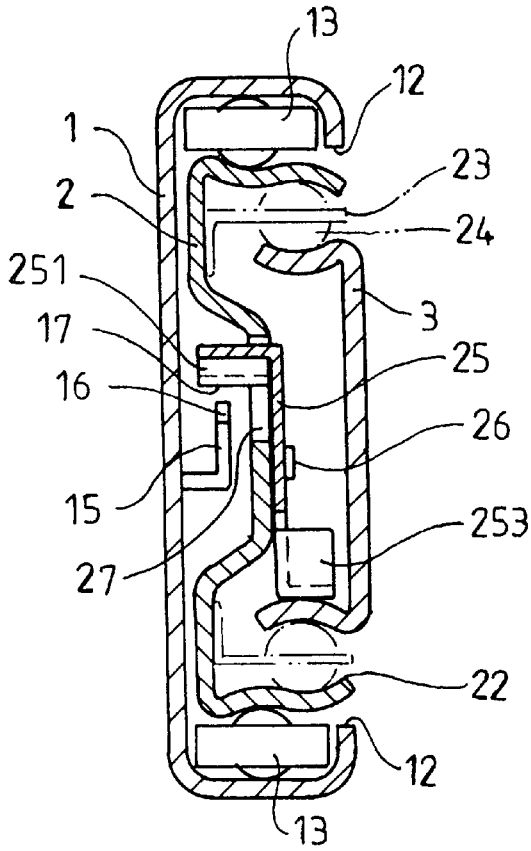
FIG. 7 is a sectional view taken along plane 7—7 in FIG. 6.
Figure 8:
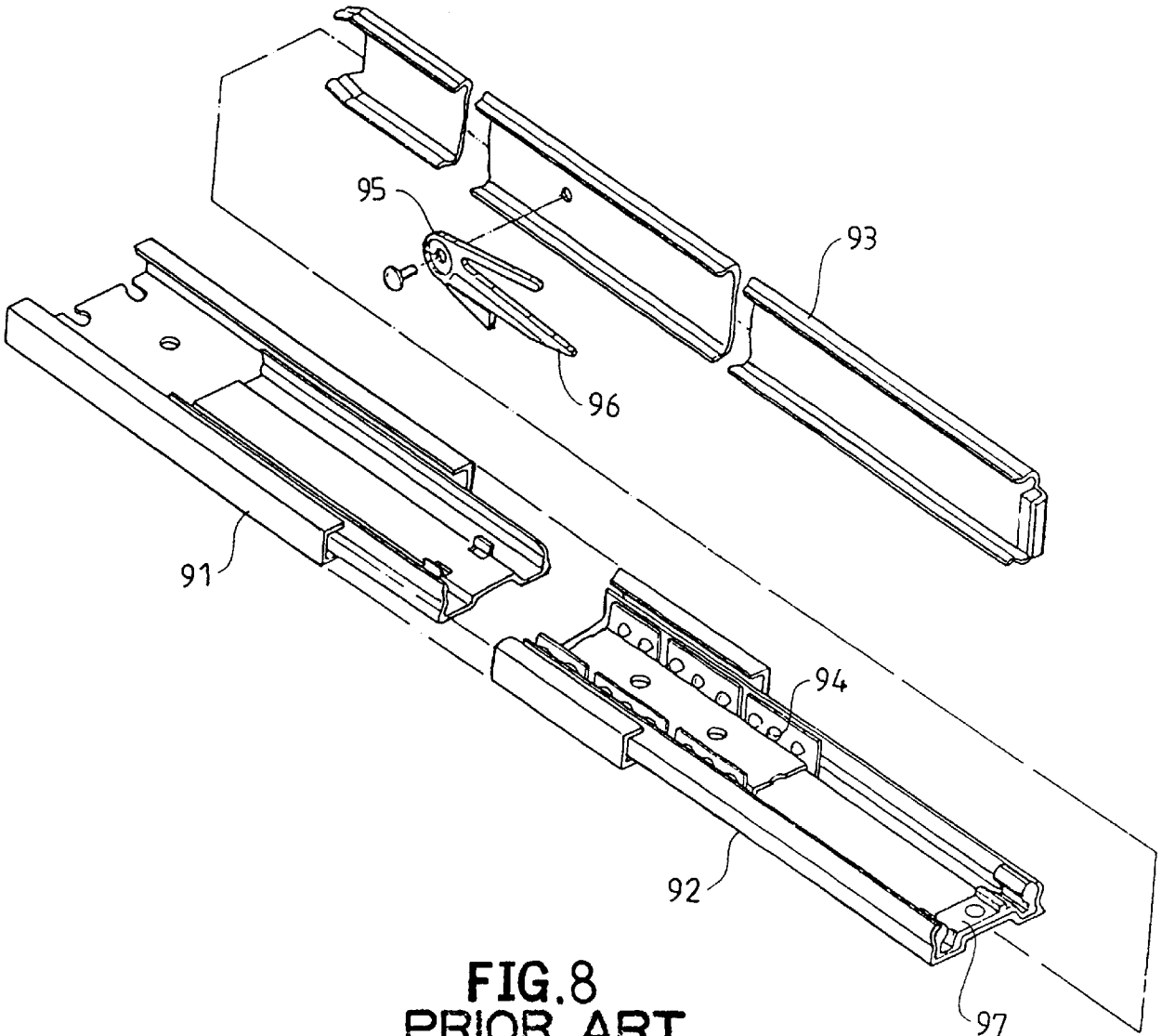
FIG. 8 PRIOR ART
FIG. 8 is an exploded perspective view of a conventional track device for a drawer.

Referring to FIGS. 6 and 7, when closing of the drawer is required, the third track 3 is moved into the second track 2 until the bottom of the third track 3 presses against the foot 253 of the first engaging member 25, which causes the extension member 251 of the first engaging member 25 to move upward, thereby disengaging the engaging section 252 from the stepped retaining portion 16 of the engaging block 15. Thus, further inward collapsing operation of the track device is allowed.

The track device in accordance with the present invention is attached to each of two lateral sides of a drawer. Extending operation of the track device can be accomplished without difficulty by means of crossing of the engaging block 15 of the firs track 1. Inward movement as a result of inadvertent impingement is limited by means of provision of the engaging section 252 of the first engaging member 25 on the second track 2 and the stepped retaining portion 16 of the engaging block 15 on the first track 1. Thus, sudden inward movement of the track device and the resultant injury to the user are avoided.

Although the invention has been explained in relation to its preferred embodiment as mentioned above, it is to be understood that many other possible modifications and variations can be made without departing from the scope of the invention. It is, therefore, contemplated that the appended claims will cover such modifications and variations that fall within the true scope of the invention.

What is claimed is:

1. A track device comprising:

a first track comprising an upper longitudinal lip and a lower longitudinal lip, the first track further comprising a first stop and an engaging block having a retaining portion;

a second track slidably received between the upper longitudinal lip and the lower longitudinal lip of the first track, the second track comprising a second stop for abutting against the first stop of the first track, the second track further including a third stop with a protrusion, the second track further including an upper longitudinal lip and a lower longitudinal lip, the second track further including a first engaging member on an end thereof, the first engaging member including an extension member, the extension member including an engaging section and a foot; and a third track slidably received between the upper longitudinal lip and the lower longitudinal lip of the second track, the third track including a second engaging member for abutting against the third stop of the second track, the second engaging member including an engaging edge and a leg, the leg being pressable to allow disengagement of the engaging edge from the protrusion on the third stop;

wherein when the second track moves inward into the first track, the engaging section abuts against the retaining portion of the engaging block, thereby preventing inward movement of the second track; and wherein when the foot of the first engaging member is pressed against by a bottom of the third track, the extension member is lifted for disengaging the engaging section with the retaining portion of the engaging block.

2. The track device as claimed in claim 1, wherein the retaining portion of the engaging block is stepped.

3. The track device as claimed in claim 1, wherein the second track includes a slot for receiving a portion of the extension member of the first engaging member.

* * * * *